US012427398B2

(12) United States Patent
Rogers

(10) Patent No.: US 12,427,398 B2
(45) Date of Patent: Sep. 30, 2025

(54) METHOD OF PLAYING A STRATEGIC BOARD GAME ON A COMIC BOOK

(71) Applicant: Scott Rogers, Thousand Oaks, CA (US)

(72) Inventor: Scott Rogers, Thousand Oaks, CA (US)

( * ) Notice: Subject to any disclaimer, the term of this patent is extended or adjusted under 35 U.S.C. 154(b) by 675 days.

(21) Appl. No.: 17/880,942

(22) Filed: Aug. 4, 2022

(65) Prior Publication Data

US 2023/0038064 A1 Feb. 9, 2023

Related U.S. Application Data

(60) Provisional application No. 63/229,180, filed on Aug. 4, 2021.

(51) Int. Cl.
*A63F 3/00* (2006.01)

(52) U.S. Cl.
CPC ..... *A63F 3/00003* (2013.01); *A63F 3/00261* (2013.01); *A63F 3/00697* (2013.01); *A63F 2003/00299* (2013.01); *A63F 2003/00703* (2013.01)

(58) Field of Classification Search
CPC ..... A63F 3/00003; A63F 3/00261; A63F 3/00697; A63F 3/0052; A63F 2009/0036
See application file for complete search history.

(56) References Cited

U.S. PATENT DOCUMENTS

| | | | | |
|---|---|---|---|---|
| 2,026,082 | A * | 12/1935 | Darrow | A63F 3/00072 D21/350 |
| 2010/0193587 | A1* | 8/2010 | Boucard | G06K 19/0723 235/454 |
| 2013/0116035 | A1* | 5/2013 | Skinner | A63F 3/00533 463/31 |
| 2013/0168924 | A1* | 7/2013 | Poulos | A63F 3/00028 273/247 |
| 2014/0367913 | A1* | 12/2014 | Abreu | A63F 3/00006 273/243 |
| 2017/0076625 | A1* | 3/2017 | Bonner | G09B 1/00 |
| 2022/0305838 | A1* | 9/2022 | Moyse | B42F 21/02 |

* cited by examiner

*Primary Examiner* — James S. McClellan
(74) *Attorney, Agent, or Firm* — ONE LLP

(57) ABSTRACT

A method of playing a board game that includes providing a comic book comprising a plurality of pages having content printed each page. One or more character tokens are provided, where each character token depicts a different pose of a superhero character that may be placed over content printed on one or more of the plurality of pages. Resource tokens are provided that represent thoughts or actions of a superhero character that may be placed over content printed on one or more of the plurality of pages. A character tableau board is provided that displays information about the character. An adversary board is also provided that displays the name and an image of a villain, and panes for placing crises cards, threat cards, and attach card. Finally, a plurality of crises cards are provided, where each crisis card depicts as action crisis that affects resource tokens attributed to a character.

1 Claim, 1 Drawing Sheet

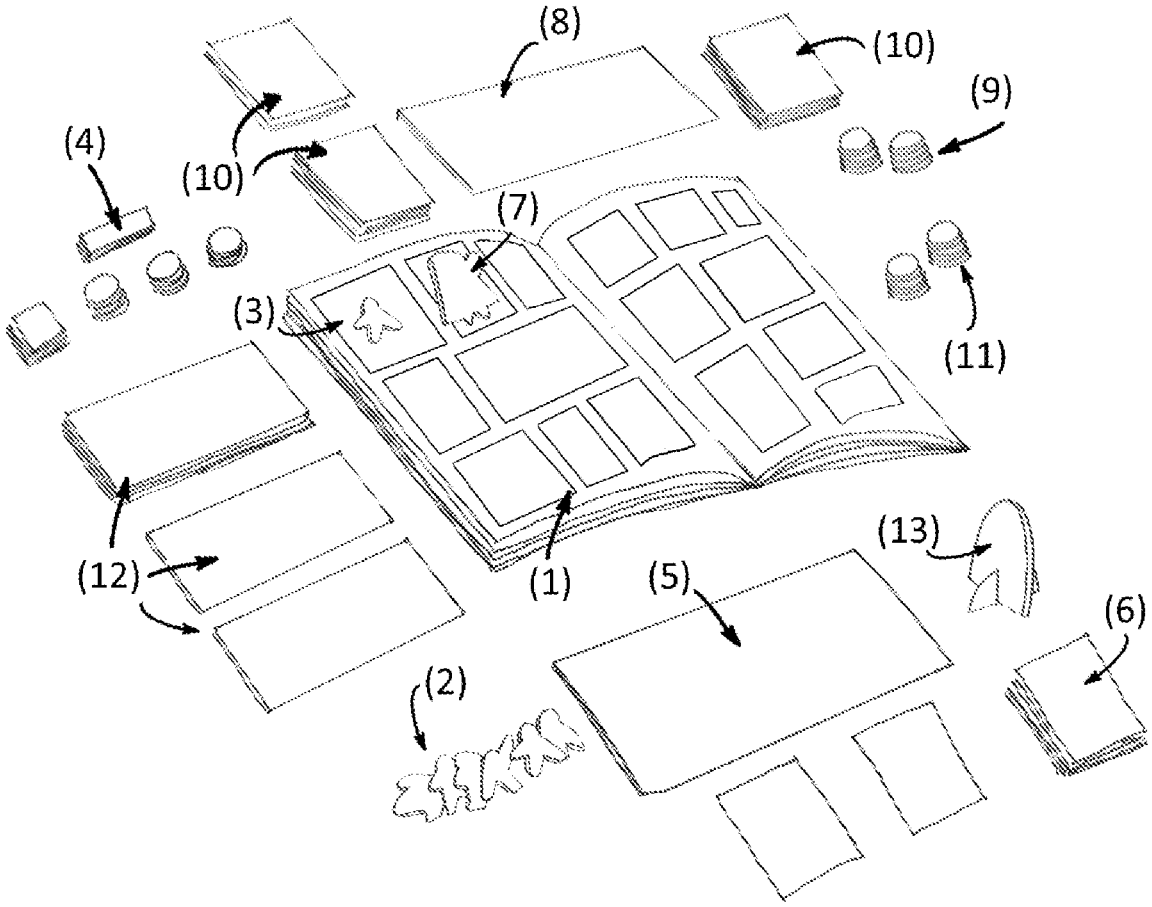
(8)
(10)
(9)
(4)
(10)
(7)
(3)
(11)
(12)
(1)
(13)
(5)
(6)
(2)

METHOD OF PLAYING A STRATEGIC BOARD GAME ON A COMIC BOOK

CROSS-REFERENCE TO RELATED APPLICATIONS

This application claims priority to U.S. Provisional Application No. 63/229,180, filed Aug. 4, 2021, which is herein expressly incorporated by reference in its entirety for all purposes.

TECHNICAL FIELD

The present disclosure generally relates to board games and, in particular, to a method of playing a strategic board game on a comic book.

BACKGROUND

Comic book enthusiast are always looking for new ways to to enjoy the comic book experience. In the same way, board game players are always searching for was to expand the gameplay experience. A need therefore exists for a dynamic gaming system that can turn any comic book into a unique gameplay experience.

SUMMARY OF THE INVENTION

A strategic board game for one, two, three or four players is disclosed. The game is played on any comic book, graphic novel, manga, or fumetto.

The game is comprised of several components including tokens, cards, miniatures, tiles and player boards. Players place tokens and other components onto the comic book's pages. Depending on the printed contents on the page, resources (additional tokens, cards, etc.) placed onto the comic page to be collected by the player. Resources are placed onto the tableau board to buy, modify or improve the functionality of the player's abilities during play. The objective of the game is to defeat a card-driven automata (known as "the Adversary") by either reaching a pre-determined number of points, completing a pre-determined objective, or by reaching the last page of the comic book story before the Adversary's objective can be completed. The game and its components may be based on characters, events, and locations portrayed in a particular popular culture phenomenon, i.e. in a comic book, cartoon, movie, TV show, web series, book or the like. This method transforms any comic book ever published into a strategic worker placement board game.

The method of playing a board game includes providing a comic book, where the comic book comprises a plurality of pages having content printed each page. One or more character tokens are provided, where each character token depicts a different pose of a superhero character that may be placed over content printed on one or more of the plurality of pages. The method further involves providing resource tokens, where the resource tokens represent thoughts or actions of a superhero character that may be placed over content printed on one or more of the plurality of pages. A character tableau board is provided, where the character tableau board displays the name and an image of the character, background information about the character, describes basic actions unique to the character, and identifies the character's starting resources. An adversary board is also provided, where the adversary board displays the name and an image of a villain, and panes for placing crises cards, threat cards, and attach card. Finally, a plurality of crises cards are provided, where each crisis card depicts as action crisis that affects resource tokens attributed to a character.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE DRAWINGS

This disclosure may be better understood by referring to the following figures. The components in the figures are not necessarily to scale, emphasis instead being placed upon illustrating the principles of the disclosure. In the figures, like reference numerals designate corresponding parts throughout the different views.

FIG. 1 illustrates an example of a strategic board game played on a comic book, according to the teachings of the present disclosure.

DETAILED DESCRIPTION

Legend

- Numeral 1 depicts a comic book used as the game's play board, in accordance with the present disclosure.
- Numeral 2 depicts tokens representing a character.
- Numeral 3 depicts a character token 2 placed on comic book 1.
- Numeral 4 depicts resource tokens of different shapes and sizes.
- Numeral 5 depicts the player's character tableau board.
- Numeral 6 depicts a unique deck of cards.
- Numeral 7 depicts an Adversary token placed on comic book 1.
- Numeral 8 depicts an Adversary board.
- Numeral 9 depicts several tokens used with the Adversary board 8.
- Numeral 10 depicts several decks of cards used to control the automata functions of the Adversary and associated game play functions.
- Numeral 11 depicts stacks of tokens used on the comic book 1.
- Numeral 12 depicts a deck of tiles.
- Numeral 13 depicts a first player marker.

Description

FIG. 1 illustrates a comic book 1 used as the game's play board. This comic book may be included with the game or obtained through an outside source. The game's rules determine when the comic's pages are turned, creating a new play board. Cards 6 and 10, the Adversary board 8, and tiles 12 may change the rules of the game board. When end of the printed story is reached, play ends.

Each token 2 represents a character—such as from a comic book, movie or some other intellectual property. The token may be placed on the comic book 1, as shown by Numeral 3.

As shown by numeral 3, a token 2 may be placed on the comic book and, depending on where it is placed and the contents of the comic book page, the player may collect resources.

Numeral 4 shows the tokens 2 that the players can collect from the comic book pages of varying shapes, sizes and functions.

Numeral 5 illustrates the player's character tableau board. This board 5 contains information about play, characters, and rules and/or might include spots on the board for tokens to be placed and where score may be tracked.

Numeral 6 illustrates a unique deck of cards that each player use to gain additional abilities or information. Each player will have a unique deck with rules and objectives that pertain to their character.

Numeral 7 represents a token that represents an Adversary character—such as from a comic book, movie or some other intellectual property. The Adversary token is placed on the Adversary board 8 but may also be placed on the comic book 1 to affect the rules, generate tokens, change or modify the information on the comic book. The play of the token is dictated by cards 10.

Numeral 8 demonstrates an adversary board 8 comprised of information about a character from a comic book, movie or some other intellectual property. Tokens 9 are placed on the board indicating the game state or moved to a different location on the board to indicate status or act as a timing mechanism.

Numeral 9 illustrates tokens on the adversary board 8 that may be moved to another location—either the comic book 1, the adversary board 8, or character board 5 which may change the game state including rules, objectives, or act as a timing device.

Numeral 10 depicts several decks of cards that control the automata of the Adversary and other gameplay functions. The rules and information on the cards control the movement of the adversary token 7, may change the state of the rules; creating additional objectives or complications or they may add tokens 4, 9 and 11 to the comic book 1 or the player's tableau board 5.

Numeral 11 depicts tokens that are used in conjuncture with the rules and information generated by the adversary board 8 or cards 10.

Numeral 12 illustrates a deck of tiles. These tiles represent other play areas—such as a map or the panels of a comic book. By placing resource tokens 4 onto these tiles during play, players will satisfy a condition which is printed on the tile. The tiles conditions are comprised of information that may change game's rules, provide additional resources 4, and affect the state of the adversary board 8 and more.

Numeral 13 illustrates a first player marker that may be comprised of cardboard or wooden piece or a plastic miniature. It may be used to indicate which player goes first, and/or may be combined with other components 5, 6, 7, 8, 9, 10, 11 and 12 to create new gameplay rules.

A detailed description of the present disclosure and is provided in the attached Appendix 1, the entirety of which is hereby incorporated by reference into this disclosure.

Although the previous description illustrates particular examples of various implementations, the present disclosure is not limited to the foregoing illustrative examples. A person skilled in the art is aware that the disclosure as defined by the appended claims and their equivalents can be applied in various further implementations and modifications. In particular, a combination of the various features of the described implementations is possible, as far as these features are not in contradiction with each other. Accordingly, the foregoing description of implementations has been presented for purposes of illustration and description. Modifications and variations are possible in light of the above description.

What is claimed is:

1. A method of playing a board game, comprising:

providing a comic book, wherein the comic book comprises a plurality of pages having content printed on each page;

providing one or more character tokens, wherein each character token depicts a different pose of a superhero character that may be placed over content printed on one or more of the plurality of pages;

providing resource tokens, wherein the resource tokens represent thoughts or actions of a superhero character that may be placed over content printed on one or more of the plurality of pages;

providing a character tableau board, wherein the character tableau board displays the name and an image of the character, background information about the character, describes basic actions unique to the character, and identifies the character's starting resources;

providing an adversary board, wherein the adversary board displays the name and an image of a villain, and panels for placing crisis cards, threat cards, and attack cards; and providing a plurality of crisis cards, wherein each crisis card depicts an action crisis that affects resource tokens attributed to the character.

* * * * *